United States Patent [19]

Ursic

[11] 4,051,646

[45] Oct. 4, 1977

[54] MACHINE FOR SEALING PACKAGES

[76] Inventor: Mario Ursic, Rua Amador Bueno, 142 Sao Paulo, Brazil

[21] Appl. No.: 655,101

[22] Filed: Feb. 4, 1976

[51] Int. Cl.[2] ..... B65B 7/28; B65B 67/00

[52] U.S. Cl. ..... 53/366; 53/363; 53/369; 53/390

[58] Field of Search ..... 53/329, 300, 40, 341, 53/363, 366, 369, 371, 390

[56] References Cited

U.S. PATENT DOCUMENTS

| | | | |
|---|---|---|---|
| 2,859,575 | 11/1958 | Lehmann | 53/366 X |
| 2,886,933 | 5/1959 | Hennies, Jr. | 53/366 X |
| 3,336,729 | 8/1967 | Logemann | 53/366 |
| 3,445,988 | 5/1969 | Maier et al. | 53/366 X |

FOREIGN PATENT DOCUMENTS

| | | | |
|---|---|---|---|
| 406,032 | 1/1966 | Switzerland | 53/366 |

*Primary Examiner*—Leonidas Vlachos
*Assistant Examiner*—Horace M. Culver
*Attorney, Agent, or Firm*—Robert E. Burns; Emmanuel J. Lobato; Bruce L. Adams

[57] ABSTRACT

A machine for sealing packages comprising a frame which includes a base, a pair of generally parallel columns extending upwardly therefrom, and a member spanning between the columns for maintaining the columns generally parallel. An upper die is mounted between the pair of columns for traveling along the length thereof and a hollow lower die having an opening extending therethrough for receiving a package to be sealed is mounted to pivot between a position between the columns and beneath the upper die, and a position away from the column and clear of the upper die. An extractor for extracting a sealed package from the lower die comprises a plate-like member normally positioned beneath the lower die when it is at the position away from the columns. The plate-like member is dimensioned to fit through the opening extending through the lower die and is displaceable to advance into the opening thereby to extract a sealed package retained within the lower die.

2 Claims, 4 Drawing Figures

MACHINE FOR SEALING PACKAGES

According to what is well-known to all , a large part of the population of the large cities consists of single persons who live in boarding-houses or apartments. These people, simply because they live alone, or even because a proportion of them are men, do not cook at home; they take snacks away from home or purchase ready-cooked food in restaurants or pizzerias and take it home, and even in cases when there is a reasonable number of persons in the same family, there are times when the lunch or supper is taken home ready-cooked.

For this type of hot meal, the well-known packages or containers made of aluminium foil have been developed; these are hermetically sealed by means of special machines, which heat the edges of the packages with an adhesive for sticking under heat, or as a different alternative, fold, press and/or knurl said edges. Such machines are expensive to buy and to run in the case of those which seal by heating, or complicated in the case of those which seal by knurling.

The machine according to the present invention is effective to seal the packages for pizzas or meals, as referred to above, but in a different way than the known machines, which arises from a very simple form of construction, and the operation of which is also simplified. In operation, the machine under construction folds the edges of the recipient, container or package, pressing them over the lid and hermetically sealing the recipient with one single movement and without any heat at all.

The enclosed drawings illustrate the present invention, in which.

Figure 2:
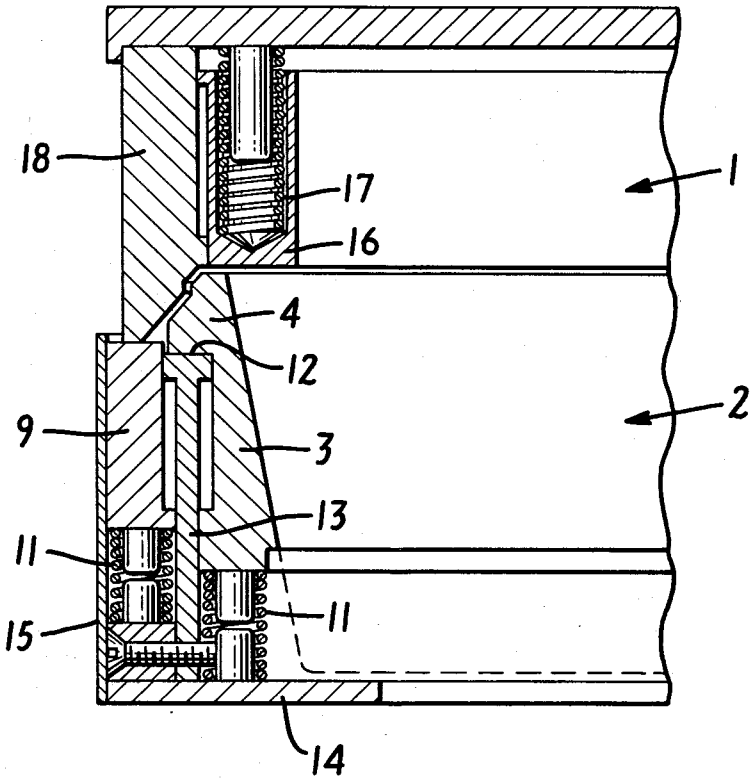
FIG. 2 shows the same sectional view of the structure illustrated in foregoing figure, but while the assembly is in the phase of sealing the package.
Figure 1:
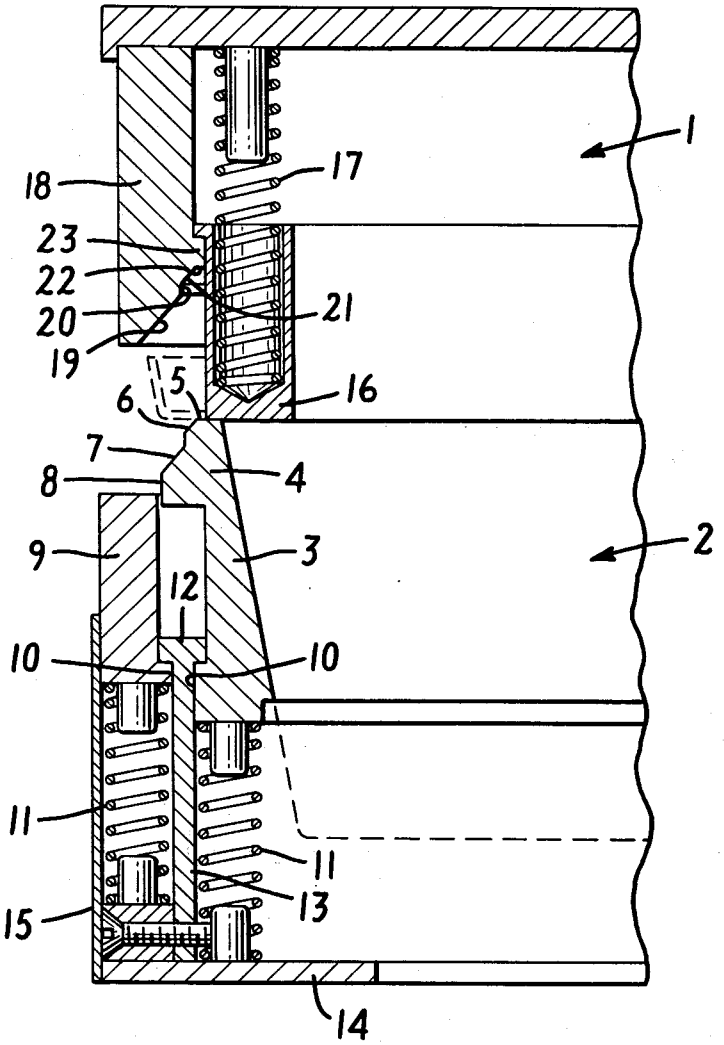
FIG. 1 shows a sectional view of the elements comprising a sealing assembly which carries out the sealing of the package, in their resting position.
Figure 3:
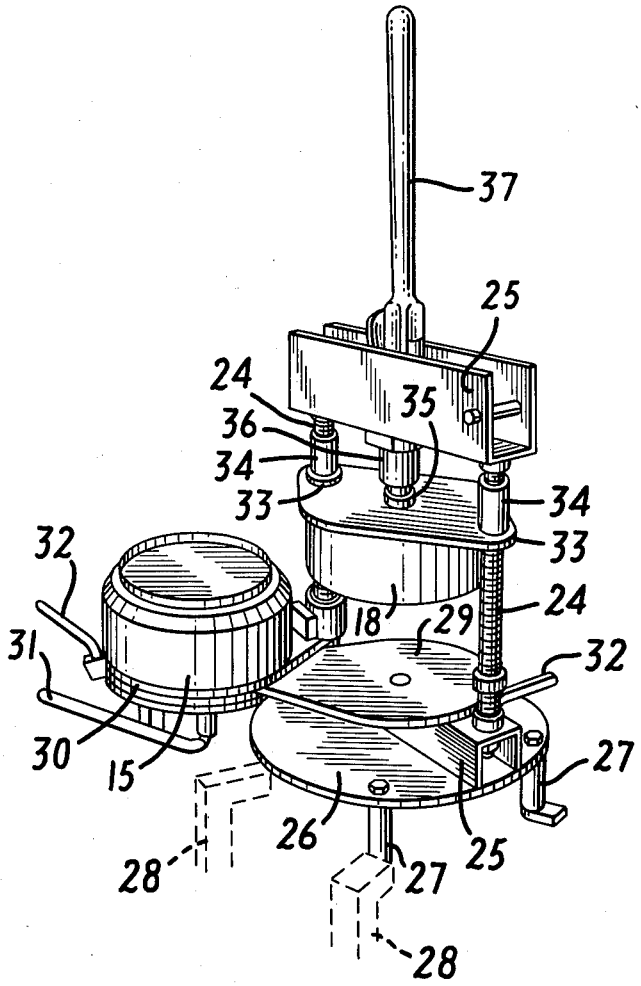
FIGS. 3 and 4 show perspective views of the sealing assembly, and mounted on a frame in position for sealing the package.
Figure 4:
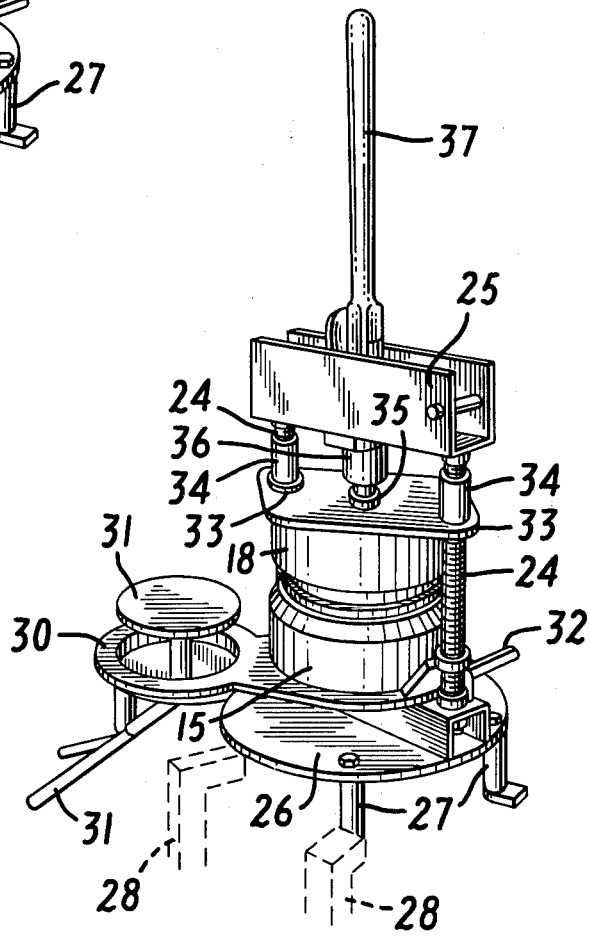

According to what is illustrated in the figures listed above, the machine for sealing packages according to the present invention is comprised, first of all, of (a) the actual sealing assembly, which has a matrix or die consisting of two parts, 1 and 2, one of them to hold the container to be sealed, and the other for sealing the container. The lower part 2 of the die functions as a support and is composed of a cylindrical component 3 having a conical internal surface, an upper widened portion 4 forming a little ring-shaped or annular top surface 5, an outside upper bevelled edge 6, a step 6*a* above a slanted surface 7 (truncated cone-shaped) which connects at its lower part, with a cylindrical surface 8, which gently fits in to the ring-shaped and outer part 9. Both of these parts, the inner one 3 and the outer one 9, are provided with flanges 10, which are ring-shaped and which reach, by means of the operation of springs 11 on which the inner part 3 and outer part are supported, an upper T-shaped flange 12, which is attached to a tubular cylindrical part 13 in an intermediary position between the parts 3 and 9, and which operates as a guide for said parts 3 and 9. The support-springs 11, mentioned above, are anchored at their lower ends to the rear surface 14, which has a circular central opening of an outside wall 15.

The upper part of the matrix is used for closing the package and is comprised of a cylindrical sleeve 16, which is very thick, with its lower inside edge being supported on the inside edge of the annular top surface 5 of the supporting matrix. The annular cylindrical sleeve 16, being supported on upper springs 17, is supported on the surface of the bottom of a cylinder 18, the walls of which are sufficiently thick to contain a surface portion having a profile complementary to to the profile of the upper portion of the supporting part 3. The profile of cylinder 18 mentioned above consists of a major sloping surface 19, placed on the inside part of the said component, and sloping outwards, said sloping length continuing upwards to a short vertical step 20 which connects with a further short sloping surface 21, laid out along the same plane as the former sloping surface 19, and ending in a horizontal surface 22, which corresponds to the lower surface of the ring-shaped projection, 23, which acts as a rest for the sleeve 16 supported on springs 18.

The assembly furthermore consists of (c) a framework or press made up of two vertical rods or columns, 24, parallel, threaded and fixed between the horizontal branches of two profile plates 25, with a U-shaped transverse cross-section. The lower one is attached to a big level and circular base 26, supported on feet 27, to be fixed by screws or chuck jaws 28 to an operating table.

On the said lower profile plate 25, one of the circular surfaces, 29, of a plate is fixed. The plate has the approximate configuration of an "8," which is to say, two partially superimposed circular areas, one of them being fixed to said lower profile plate 25 as described above, and the other, 30, placed in a sideways position relative to the upper part of the sealing assembly. The rear surface of the circular area 30 is supplied with an extractor 31, to remove the sealed container from the lower part of the sealing assembly.

The whole supporting assembly of the container to be sealed is mounted near the lower end of one of the columns 24 to pivot about the column. The supporting assembly is also provided with a locking device 32, to hold it in the sealing position, which is when the supporting assembly is in the position between said columns 24, and under the sealing assembly. The upper surface or rear surface of the sealing assembly is provided with side lugs 32, and tubular guides 34 are supplied to guide the sealing assembly along said columns 24.

Furthermore, an axle 35, sticks out upwards from the rear surface or upper surface of the sealing assembly, and it goes through a guiding sleeve 36, set up on the upper profile plate 25, and extends out beyond the profile plate 25 and receives a lever 37. The lever is operated in order to lower the sealing assembly down to the assembly which supports the container or package to be sealed.

When the machine is in its resting position, the lower part 2 of the matrix which receives the package which is to be sealed, is placed over the extractor 31, which should also be in the resting position. Pivoting the base 14 of this part of the matrix, the assembly is placed, already holding the package to be sealed, under the sealing assembly.

When the lever 37 is lowered, the whole upper part of the sealing assembly is lowered so as to fold the edges of the recipient or container and of the lid, pressing them together and turning them downwards.

For this operation, the outside corners of the edges of the ring-shaped sleeve 16 of the closing assembly are applied to the inside edges of the cylindrical component 3, of the supporting assembly for the package, thus fixing the lid over L-shaped edges of the container.

When the lever 37 is lowered, the outside cylinder 18 starts coming down, and its surface having a special profile define a mould complementary to the widened portion 4, of said cylindrical component 3. At this point, the edges or flanges of the recipient and the lid of the package are turned inwards, and folded over each other, in such a way that the edges of the recipient hold within themselves the edges of the lid, turning them downwards, and folding them in a profile which corresponds to the profile of components 3 and 18 as mentioned above.

The sealing carried out by this machine is excellent since the package, once it has been closed, is not easily opened, and, furthermore, the flanges of the closure are reinforced, and may be used as handles for removing the package and for transporting the same from one place to another.

I claim:

1. A machine for sealing packages, comprising:

a frame comprising a base, a pair of generally parallel columns extending upwardly from the base, and a member spanning between the columns at a position along the columns remote from the base for maintaining the columns generally parallel;

a sealing assembly for sealing a package, said sealing assembly comprising an upper die, means mounting the upper die between said pair of columns for traveling along the length thereof, a hollow lower die having an opening extending theretherethrough in a direction along the extent of said columns for receiving a package to be sealed, means mounting said lower die to pivot between a position between said pair of columns and underneath said upper die, thereby to permit the upper die to travel down said columns to engage said lower die and seal the package received within the opening extending through said lower die, and a position away from said columns and clear of said upper die, and means operable for displacing said upper die to travel up and down along said columns; and an extractor for extracting a sealed package from said lower die, said extractor comprising a plate-like member normally positioned beneath said lower die when said lower die is at the position away from said columns, said plate-like member being dimensioned to fit through the opening extending through said lower die, and means operable for raising said plate-like member to advance into the opening extending through said lower die thereby to extract a sealed package retained within said lower die.

2. A machine for sealing packages according to claim 1: wherein said lower die is cylindrical and includes an upper portion defined by an upper annular top surface (5) of said lower die, an annular truncated conical surfaces (6) extending from said top surface downwardly and outwardly of said lower die, a vertical annuler cylindrical surface (**6*a*) extending downwardly from said truncated conical surface, and a second annular truncated conical surface (7**) extending from said cylindrical surface downwardly and outwardly of said die; and wherein said upper die is cylindrical and includes a lower portion having a surface complementary to the upper portion of said lower die for engaging therewith.

* * * * *